United States Patent [19]

Belthle

[11] 4,324,073

[45] Apr. 13, 1982

[54] PROCESS FOR AUTOMATIC FEED OF STEADY JAWS

[75] Inventor: Heinz Belthle, Aichwald, Fed. Rep. of Germany

[73] Assignee: Fortuna-Werke Maschinenfabrik GmbH, Stuttgart, Fed. Rep. of Germany

[21] Appl. No.: 101,680

[22] Filed: Dec. 10, 1979

[30] Foreign Application Priority Data

Dec. 27, 1978 [DE] Fed. Rep. of Germany ..... 2856339

[51] Int. Cl.[3] ..... B24B 1/00

[52] U.S. Cl. ..... 51/281 R; 51/165.77; 51/238 S

[58] Field of Search ..... 51/238 S, 238 R, 105 SP, 51/165 R, 165.77, 165.91, 281 R

[56] References Cited

U.S. PATENT DOCUMENTS

| | | | |
|---|---|---|---|
| 2,961,808 | 11/1960 | Dunigan | 51/169.92 |
| 3,591,987 | 7/1971 | Porath | 51/238 S |
| 3,878,651 | 4/1975 | Nakada | 51/165.77 |
| 4,205,492 | 6/1980 | Matsuura | 51/238 S |

*Primary Examiner*—Harold D. Whitehead

*Attorney, Agent, or Firm*—Martin A. Farber

[57] ABSTRACT

The disclosure relates to a process for the continuous, automatic feed of at least one jaw of a steady for supporting a workpiece, for example a shaft or crank shaft with its axis in the desired position on grinding the workpiece outer face and is more specially with respect to a process in which a workpiece freely supported between two support units, as for example two centers, is acted upon by its own sagging force, the radial force of the tool, for example a grinding wheel, and other forces produced on machining the workpiece, which may be radial or tangential with respect to the axis. The disclosure is furthermore with respect to an apparatus for undertaking the process.

3 Claims, 5 Drawing Figures

PROCESS FOR AUTOMATIC FEED OF STEADY JAWS

On grinding cylindrical workpieces, sagging, more specially in the case of thin shafts or crank shafts and the like, gives rise to serious shortcomings. On the one hand the supported workpiece is acted upon by its own weight and furthermore there is the radial force of the grinding tool and the tangential force coming into play on machining with a turning grinding wheel. However, a thin shaft or an other workpiece which is readily bent may be viewed as a column whose buckling is likely to be caused by the axial force of the tailstock center. All these forces acting upon the workpiece to be machined will have the tendency of forcing it out of its axial position. Although such a motion out of position may not be seen or may hardly be seen by eye, it may certainly be sensed with measuring instrument as sagging or bending, that is to say a condition in which the workpiece is no longer in its true axial position. For this reason the grinding operation on a workpiece, whose true diameter is frequently to be machined (by grinding) down to a limit within one micron with a very low eccentricity and the highest possible degree of concentricity, is very much dependent on these conditions and if grinding does not take place within the limits noted, the workpiece may not be further used, that is to say it is waste. For stopping a workpiece going out of the axial position because of the forces noted, that is to say sagging, it is normal to make use of a steady, which has a supporting effect opposite to the forces producing the sagging. In the simplest case the adjustment of such a steady at the desired position of the workpiece may take place by hand, but, however, in this case a very great degree of experience and skill with the hand are necessary, so that such work may only be undertaken by trained workers. Furthermore there are certain limits in this respect, that is to say on the one hand in view of the size of the workpiece and on the other hand the great need for precision with respect to the workpiece's being out of round (tolerances in the diameter of the workpiece), which may be in the micron range. Follow-up steadies automatically worked by pulses and stepping motors have been designed with which workpieces of very great size and, equally, very small workpieces may be supported exactly in position for machining. In this case a lower and an upper steady jaw are moved up against the workpiece for producing a supporting effect putting an end to sagging, and then forced against the workpiece. Then by way of a stepping motor, controlled by measuring feelers, they are continuously moved further dependent on the grinding taking place on the workpiece. The measuring feelers are, for this purpose, placed against the outer face of the workpiece and are responsible for producing pulses which are representative of the decrease in diameter as it takes place. These pulses go to the stepping motor for continuous feed of the jaws of the steady for moving them up against the workpiece being machined. The tool support with the grinding wheel on it undergoes feed, without being dependent on the steady, as fixed by a program till the true diameter of the workpiece is produced. This feed as well takes place continuously in a number of feed steps or in one changing feed operation (adaptive control). Such a system, which is something meeting the needs for precision today on grinding tools of the sort noted, is high in price because of its complex structure and has furthermore the great shortcoming that it may not be used for all shafts, more specially crank shafts, and small shafts with narrow journals to be machined, because in many cases there is not enough room for the jaws of the steady, on the one hand, and, on the other hand, for the necessary feeling parts or measuring feelers.

Furthermore such systems are in each case fixed on a grinding machine. For this reason they may only be used for shafts and the like with a certain range of diameters for which the grinding machine is designed.

One purpose of the present invention is that of making possible feed of the jaws of steadies, of which, for this purpose, at least one is automatically controlled by a stepping motor, towards a workpiece, while at the same time measuring the decreasing workpiece diameter all the time using a distance measuring system down as far as the true diameter at the time of grinding, which in addition to other important useful effects may be used, unlike old systems, furthermore for machining shafts with very small sizes and/or journals and the like. Furthermore with the invention it is to be possible for machines with the necessary electric or electronic control system to be changed and used with such steadies. Because the steady of the invention is a multi-range steady, the grinding machine in this case may readily be used for grinding workpieces with a diameter of 5 to 70 mm.

In the invention this is made possible in the case of a process for the continuous, automatic feed of at least one jaw of a steady for supporting a workpiece, for example a shaft or crank shaft with its axis in the desired position on grinding the workpiece outer face and is more specially with respect to a process in which a workpiece freely supported between two support units, as for example two centers, is acted upon by its own sagging force, the radial force of the tool, for example a grinding wheel, and other forces produced on machining the workpiece, which may be radial or tangential with respect to the axis, because at least one jaw of the steady is moved up towards the workpiece and shortly before touching the outer face of the workpiece a stepping motor, joined with the jaw, is switched over by a feeler, present in the jaw or the touching part, to slow forward running and in that the steady jaws are then moved by the stepping motor normally to the center axis of the workpiece as far as a certain value and then the workpiece undergoes grinding by a tool which is opposite to one steady jaw diametrally and is able to be moved forwards by a further stepping motor oppositely with respect to the diametrally opposite steady jaw, and, once the steady jaw has sensed the same diameter as the grinding wheel, or a diameter corrected by a distance measuring system of the steady jaw, the steady jaw is switched over to synchronous running at a speed $V_2$, so that from now onwards the steady jaws and the grinding wheel support, placed diametrally opposite it, are moved towards each other in step or synchronously as far as fixed true diameter of the workpiece, and in that on getting to this true diameter the forward motion is stopped at both sides and the steady jaw and the support of the grinding wheel are moved away from each other.

In an other possible form of the invention it is possible to make use of systems made up of a pulse generator, an electronic computer unit and a distance measuring system for controlling a stepping motor, there being one such system for the upper and one such system for the lower steady jaw. With this form of the invention each steady jaw may be moved by itself by way of the pulses going to its stepping motor towards the workpiece or away from it.

The apparatus for undertaking the process of the invention, made up of at least one steady jaw, and a grinding wheel support, placed generally diametrally opposite to the steady jaw, and having a grinding wheel placed on it, and a stepping motor able to be moved towards the workpiece and away from it again, and a second stepping motor designed for moving the grinding wheel support towards the workpiece and back again, is characterised by an upper steady jaw and a lower steady jaw, joined mechanically and drivingly with the upper jaw, and in the upper steady jaw near the diametral axis (upper steady jaw-machining tool) a sensing unit and an electronically controlled computer unit, getting its input from the sensing unit with two distance measuring systems, are present for controlling in relation to the input true diameter of the workpiece using comparison of measured values in each case, with the desired diameter at any time on the one hand, and the feed of the steady jaw or jaws and on the other hand the feed of the grinding wheel support by way of the stepping motors and for stopping them lastly on getting to the true diameter.

Further measures and useful effects of the invention will be made clear from the accompanying drawing, in which one working example of the invention is to be seen.

Figure 2:
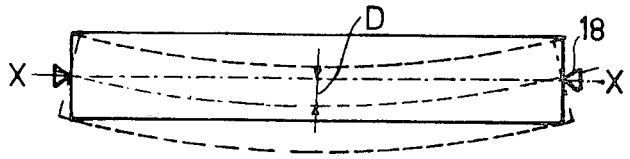
FIG. 2 is a view of a shaft supported between two centers of a grinding machine.

In line with the general teaching of the invention, a measuring sensor or feeler 1 is joined with a pulse generator 2, by means of which a stepping motor 3 is switched in its separate switching stages for moving steady jaws, joined with each other, that is to say an upper steady jaw 4 and a lower steady jaw 5. Once the steady jaw 4, supporting the measuring feeler, comes up against a workpiece, for example a shaft 6, and the measuring feeler is, for this reason acted upon, a pulse is produced, which has the effect of switching over the stepping motor from the high feed speed $V_1$ of the steady jaws to a lower speed $V_2$. Then by way of a preset counter 7 and using a pulse preset in the counter, a feed motion of the steady jaw is controlled which is representative of an opposite force, fixed by experience, for the bending or sagging D of the shaft 6 to be machined, so that the shaft 6 is firstly statically trued up with the axis X—X. Now the grinding wheel support 8 with its wheel 9 is moved up by a second stepping motor 10 towards the workpiece. At the time of the grinding operation the steady jaws 4 and 5 are moved by the first stepping motor 3 and the grinding wheel 9 is moved by the second stepping motor 10, such motion being in opposite directions. The motions produced are controlled by the two stepping motors 3 and 10 automatically using two distance measuring system WES 1 and WES 2, in the case of which one system, WES 1 is used for the steady jaw and the other is used for the grinding wheel support 8, comparison taking place all the time by using an electronic unit 12 having as an input the true diameter of the workpiece 6, and its desired diameter. The position $\Delta a$, $\Delta b$ of the steady jaws, 4, 5 on the one hand, and of the grinding wheel support 8 on the other, respectively, is, for this reason, a simple function of the thickness, cleared by grinding, from the outer part F of the shaft or workpiece 6 to be machined.

In this connection it is furthermore to be noted that for balancing all sagging of the workpiece, it is not only the effects, which may be sensed, noted earlier and which are the cause of the sagging D, which may be taken into account in the way noted and in fact there are temperature and coolant effects and other heating effects, in as far as they have been recorded in earlier experience in a table for separate sorts of workpieces, which may be programmed as further conditions causing sagging, in a preselection unit for any further correction necessary, which will then be responsible for a greater feed motion of the steady jaws towards the workpiece.

It will be seen that the system has as the most important parts, in addition to the true multi-range steady jaws 4 and 5—that is to say jaws whose adjustment may be made to different diameters of a shaft—a stepping motor driving unit 11, a digital distance measuring system, and a measuring feeler 1 for high speed moving up of the steady jaw with decreasing or unchanging diameters and a matching computer 12 for the steady jaw distance measuring system with respect to the end diameter of the workpiece (true diameter) on backward motion of the steady jaw and, lastly, a display 13 for the wear of the steady jaws 4 and 5 and possibly a measuring feeler or pin. In this respect it is to be noted that the two steady jaws 4 and 5 only have one measuring feeler between them, which is best placed on the upper steady jaw 4, which is only moved in common by the one stepping motor 3 towards the workpiece and back from it again.

Started by the "start" instruction, the steady jaws 4 and 5 are moved with a starting speed $V_1$ (fixed in the program) towards the workpiece 6. The measuring feeler 1, which takes the form of a measuring pin being able to be pushed against the force of a spring in the steady jaw 4, or furthermore may take the form of a proximity sensing unit, makes contact with the workpiece. In the first case (with a measuring pin) at this point in time, there is still a certain distance of for example 1.3 mm between the steady jaw 4 and the workpiece outer face. After a further motion of about 0.2 mm on the part of the jaw, into which the measuring pin is now pushed, the first switching instruction is produced, by which the stepping motor 3 is switched down from its greatest speed $V_1$ to a slower speed $V_2$, which is greater or smaller than the speed $C_2$ of the grinding wheel support 8. The question of if the speed $V_2$ is made greater or smaller is dependent on if the grinding wheel support is in front of or behind the steady with respect to the workpiece radius. The steady jaws 4 and 5 now come up against the workpiece outer face with a bending of the workpiece through the distance, fixed by experience, against the grinding wheel 9. The digital or other distance measuring WES 1 of the steady jaw is now responsible for measuring over the position now taken up by the steady jaw, with respect to the workpiece axis, the same being done in the case of the grinding wheel support as well. The grinding wheel which has been started on its way towards the steady jaw, for example some distance ahead, is now no longer in front of the steady jaw, because the last-named is moved more quickly, something which is made possible by comparison all the time between the two distance measuring systems WES 1 and WES 2, if the two, that is to say the grinding wheel and the steady jaw are at the same radius, i.e. where $\Delta a = \Delta b$, or the steady jaw is at a corrected radius. From this time onwards the grinding wheel support and the steady jaw are moved at the same speed $C_2 = C_1$ in step (or synchronously) towards the workpiece. If any change takes place in the rate of feed of the grinding wheel support $C_2$, the rate of feed $C_1$ of the steady jaw has to be changed in step. Any desired opposite sagging or bending of the workpiece, produced by the steady jaws in relation to the grinding wheel, is produced by the position of the steady jaw being changed, that is to say moved further forwards out of the position in theory.

Figure 1:
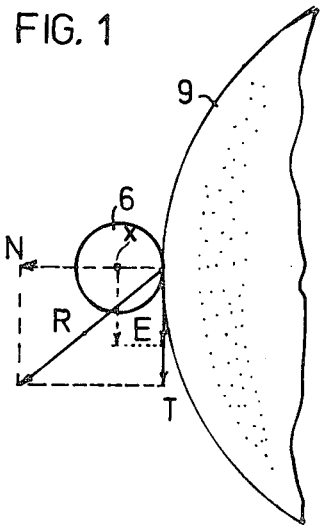
FIG. 1 is a diagram of the forces acting on a workpiece, supported in a grinding machine, not viewed in detail, at the time of machining the workpiece.

In FIG. 1 the most important components of the forces, by which a workpiece is acted upon on machining, and the opposite parallel forces balancing the forces, are to be seen diagrammatically. From this diagram of the force components, it will be seen that the outcome is the overall force R, acting on the shaft 6 and responsible for sagging or bending D of the shaft (FIG. 2), so that the shaft is moved away from its true axial position X—X. For balancing this axial motion out of the normal position, the two steady jaws 4 and 5 are used for producing an opposite force. In this respect the other steady jaw 4 has a measuring feeler 1, which in the present working example of the invention is a measuring pin, which is placed in a hollow made for it in the jaw 4 axially and it may be moved in, for example, a sleeve 14 against the force of a spring (FIG. 3). Its free end 15 comes out of the bushing of the steady jaw 4. In the working example at present in question for the effect on the shaft, for producing sagging, use is made in a normal way of two steady jaws 4 and 5, in which respect the top jaw 4 is so drivingly connected with the lower jaw 5 that on starting the steady, the top steady jaw 4 and, at the same time, furthermore, the lower steady jaw 5, are forced against the shaft 6 with an effect opposite to the sagging force R. It is furthermore to be noted that the steady jaws 4 and 5 are fixed by screws 16 on the jaw part or steady part 17 so as to be able to be unscrewed from it. Furthermore the steady jaw 5 may be moved in relation to the jaw 6 separately for adjustment.

Figure 3:
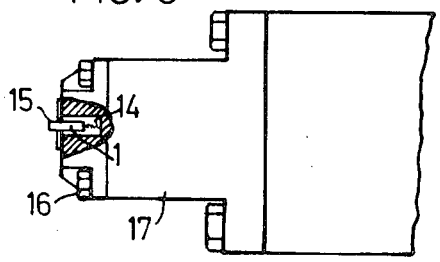
FIG. 3 is a view of part of a steady with jaws and measuring feelers, there being a section in the front jaw or supporting parts.
Figure 4:
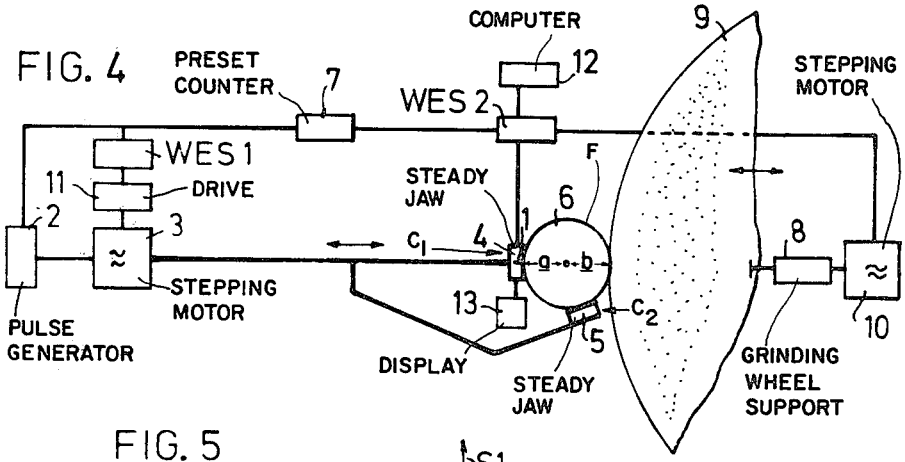
FIG. 4 is a view of electronic switching stations controlled by the measuring feeler in the jaws of the steady, and of the driving parts.

It is furthermore to be made clear that FIG. 2 is a diagrammatic view of a grinding machine, in which between two centers 18 the shaft 6 is supported. The forces acting on the shaft 6 are, on the one hand, the force dependent on its weight, responsible for sagging D—the force component E—and furthermore the pushing or radial force of the grinding wheel, normal on grinding—that is to say component N—and the tangential force produced on grinding, which is caused by the turning motion of the grinding wheel—the force component T.

Figure 5:
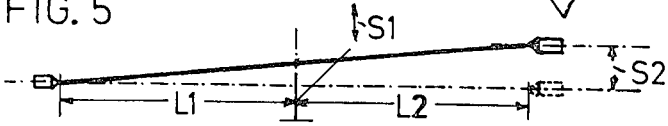
FIG. 5 is a diagram of correction of the tailstock.

It is furthermore to be noted that as soon as the centers are changed in position in relation to the workpiece supported for grinding, its axial position X—X will be changed as well. This, however, is responsible as well for a change in the matching of the steady jaws and the matching of the grinding wheel, so that, in a limiting case, the workpiece may be machined so as to be conical. For stopping this from taking place, there is the further suggestion, forming part of the invention, of having a cylinder compensation unit on the tailstock, which is controlled in the same way as noted earlier by a distance measuring system with a driving unit. So in the case of the use of the steady together with a tailstock with automatic cylindrical error correction, the steady correction in relation to the correction of the tailstock is in line with the projective geometry:

$$\Delta S_1 : S_2 = L_1 : L_2; \Delta S_1 = \frac{L_1 \cdot S_2}{L_2}, \qquad \text{FIG. 5}$$

An important measure of the apparatus is the matching of the steady distance measuring system, of which an account will now be given in the case of a workpiece after full grinding:

As soon as grinding of the workpiece has been ended, the switching off instruction comes and the grinding wheel support 8, together with the frame of the steady are moved back into their starting positions. At the start of the back motion of the frame of the steady and of the jaws on it, the distance moved is measured, the first step for this being that the workpiece, which in any case is bent towards the grinding wheel and in an upward direction, is moved back into its unforced position. Before this point, the workpiece and the jaws of the steady are still moved together in step, that is to say the workpiece still resting against the jaws 4 and 5 makes the same motion as the frame of the steady which is being moved back, so that the measuring pin is still kept unmoving in the sleeve 14. However, starting with the backward motion of the frame of the steady, the control system keeps a watch on the measuring pin which, once the workpiece has gone into its unforced position and has cleared the steady frame being moved backwards, is moved by a spring out of the sleeve. The start of this motion of the measuring pin is the direct cause of a change in an electrical signal, so that even after a motion of the measuring pin of as little as about 1 micron the instruction is given for matching of the steady to be in line with the finished size of the workpiece. Because the finished diameter of the workpiece is stored in a computer, the size may be obtained from the computer. By way of this matching of the steady, which is normally undertaken with a workpiece after full grinding used as a gauge, all the time, certain errors are eliminated and certain values are produced, that is to say:

1 Bending of the workpiece towards the grinding wheel by the steady.
2 Bending of the workpiece by the grinding wheel towards the machine-user.
3 Wear of the steady jaw 4 and, in a roundabout way, of the jaw 5 of the steady as well.
4 Stopping any heat effects in the position of the steady jaw 4 in relation to the center axis.
5 Stopping any workpiece position errors still in existence after the last cylindrical error correction, with respect to the steady jaw 4 (the workpiece position error is to be smaller than the force acting on the workpiece, that is to say in cases in which there are small correction errors at the tailstock and the steady is not corrected in the relation of the projective geometry but on moving back the steady jaw 4 at the finished diameter of the workpiece).
6 Measuring pin wear in the case of the steady jaw 4.

7 A change in the adjustment of the force on the workpiece caused, for example, by changes in position of parts of the machine produced by heat, tailstock cylinder error corrections, which stretching over a number of machining operations are for balancing a tendency. Corrections in the case of a workpiece of the order of size of 1 to 2 microns do not have any bad effect on the steady and may be balanced out at the end of the grinding operation.

What we claim is:

1. A method for the continuous automatic feeding of steady jaws for holding a workpiece, such as a shaft in its axis during machining of the outer face of the workpiece, comprising the steps of advancing at maximum speed two steady jaws and a grinding wheel, with the grinding wheel diametrally opposite to an upper one of the steady jaws, at a beginning of the machining, transversely to the axis of the workpiece to be machined, toward a pre-programmed distance relative to the workpiece, reducing the speed of advance, and stopping the advancing of the steady jaws at the predetermined distance from the workpiece, feeding the steady jaws from this predetermined distance with respect to the grinding wheel, as the grinding wheel stands still, further by a distance corresponding to prestressing on the workpiece, stopping said steady jaws again to define a rest position, driving from this rest position both of the steady jaws and the grinding wheel for the machining of the workpiece with a predetermined synchronous feed speed diametrally with respect to each other with an upper one of the steady jaws toward the grinding wheel, toward the workpiece, until a finished machining size is achieved on the workpiece, and stopping the steady jaws and the grinding wheel and bringing them back to their initial position.

2. A method of the continuous automatic feeding of steady jaws for holding a workpiece, such as a shaft in its axis during grinding of an outer face of the workpiece, comprising the steps of moving two steady jaws against the outer face of the shaft, acting on the shaft by the steady jaws such that the steady jaws counteract a resultant force which tends to cause a sagging of the shaft during the grinding, grinding the shaft by a grinding wheel, continuously measuring by a distance measuring system, the instantaneous distance $\Delta a$ of a setting distance a of the steady jaws from the outer face of the shaft in a transverse direction to the axis, on the one side, and the instantaneous distance $\Delta b$ of a feed path b of the grinding wheel from the outer face of the shaft in transverse direction to said axis on the other side during the grinding step, comparing the distances which are measured with one another in an electronic computing unit, alternately increasingly and respectively decreasingly adjusting the moving speed of the steady jaws or the moving speed of the grinding wheel, upon deviation of the instantaneous distance $\Delta a$ of the setting distance a of the steady jaws with respect to the instantaneous distance $\Delta b$ of the setting distance b of the grinding wheel so as to attain equal lengths $\Delta a = \Delta b$ of the distances $a = b$.

3. The method according to claim 2, further comprising the step of matching the distance of the steady jaws on the shaft after it has already been completely machined to a true diameter by, storing in the electronic computing unit a sudden axial movement of a contact measuring pin under spring bias, by utilizing an axially displaceably mounting movement of the contact measuring pin in a steady spindle sleeve, the pin engaging with its front free end against the outer face of the shaft, upon removal from the shaft after the complete unstressing of the latter and further returning movement of the steady jaws away from the shaft, after suddenly becoming free upon pulling away of the applied counter-force, the measuring pin springing out of the spindle sleeve, releasing during the instant of the start of this axial movement an electric value, retrievable storing the latter as a desired diameter of the shaft.

* * * * *